United States Patent [19]

Rasler

[11] 4,383,669

[45] May 17, 1983

[54] INVERTIBLE DUAL CARRIER FOR LADDER-TOP USE

[76] Inventor: Raymond E. Rasler, E. College Ave., R.R. #2, Greenville, Ill. 62246

[21] Appl. No.: 243,638

[22] Filed: Mar. 13, 1981

[51] Int. Cl.[3] ..... E06C 7/14

[52] U.S. Cl. ..... 248/210; 16/DIG. 23; 248/DIG. 11; 248/DIG. 12; 248/238; 248/311.2

[58] Field of Search ..... 248/210, 211, 236, 238, 248/310, 311.2, 311.3, 314, 346, DIG. 11, DIG. 12; 134/92; 220/96; 297/3; 16/114 B, 122, 126, DIG. 23

[56] References Cited

U.S. PATENT DOCUMENTS

| | | | |
|---|---|---|---|
| 768,364 | 8/1904 | Hines | 248/210 |
| 1,193,809 | 8/1916 | Mauk | 312/237 |
| 2,646,808 | 7/1953 | Yenne | 134/92 |
| 2,750,709 | 6/1956 | Saverino | 248/188.2 |
| 2,837,306 | 6/1958 | Elm | 248/210 |
| 2,911,133 | 11/1959 | Ruggieri | 248/210 X |
| 3,642,239 | 2/1972 | Zeiler, Jr. | 248/210 |
| 3,822,847 | 7/1974 | Emmons | 248/210 |
| 3,892,331 | 7/1975 | Beck | 220/96 |
| 3,901,165 | 8/1975 | Schlesinger | 108/149 |
| 4,118,002 | 10/1978 | Bartlett | 248/311.2 |

FOREIGN PATENT DOCUMENTS

| | | | |
|---|---|---|---|
| 2046825 | 11/1980 | United Kingdom | 248/238 |

*Primary Examiner*—James T. McCall
*Assistant Examiner*—David L. Talbott
*Attorney, Agent, or Firm*—Jerome A. Gross

[57] ABSTRACT

A carrier for tools, painters' supplies and the like, for use on the top of a folding ladder, is invertible, providing a selection between two tray-like receptacles of different depths having a common planar bottom which rests on the ladder top. The rectangular wall of the inverted tray portion holds the carrier securely on the ladder top. Handles, drawn upward to whichever side is presented upward and then inward, spring back and retract out of the way by gravity.

3 Claims, 2 Drawing Figures

INVERTIBLE DUAL CARRIER FOR LADDER-TOP USE

TECHNICAL FIELD

This invention relates to a carrier useful atop a folding ladder, for accommodating paint cans, cleaning equipment, tools and the like, and especially to such a carrier adapted for manufacture by plastic molding.

BACKGROUND ART

Persons working from ladders may need some sort of carrier for holding paint cans, tools and the like. This need is recognized in numerous patents, many of which show attachment of some device to the side rail of a ladder above one of the steps or rungs.

The flat folding shelf of a typical folding ladder is utilized, in U.S. Pat. No. 3,642,239 to Zeiler, in a device to hold a paint can. This device employs adjustable bracket angles below a top plate to grasp the ladder shelf.

DISCLOSURE OF THE INVENTION

The present device, well suited for molding of plastic in a simple mold having a parting plane (but also simply constructed of wood or metal) is an invertible dual carrier; it has two tray-like portions of different depths. When one is presented upward, to hold paint cans, the other fits downwardly over the ladder top. Unique handles are provided, to be available for use from either side, preferably closed loops having elastic bendable vertical portions drawn upward through bores in side edge extensions of the common bottom wall of the trays. The handles retract automatically, to offer no interference to the work carried on. The sideward extension at the step side of the ladder is narrow; at the opposite side and the end edges, broader extensions are provided, with holes to accommodate paint brushes, hand tools and the like.

BEST MODE FOR CARRYING OUT THE INVENTION

When a user works on a step ladder, he will find it most useful to have, alternately available to him, a shallow tray and a deep tray, to hold tools, paint cans, paint brushes and other useful articles. The most convenient position for such a device is at the ladder top. The convenience of the device will be enhanced by provisions which make it useful as a carrier for the paint cans, tools, etc. to be used.

Figure 1:
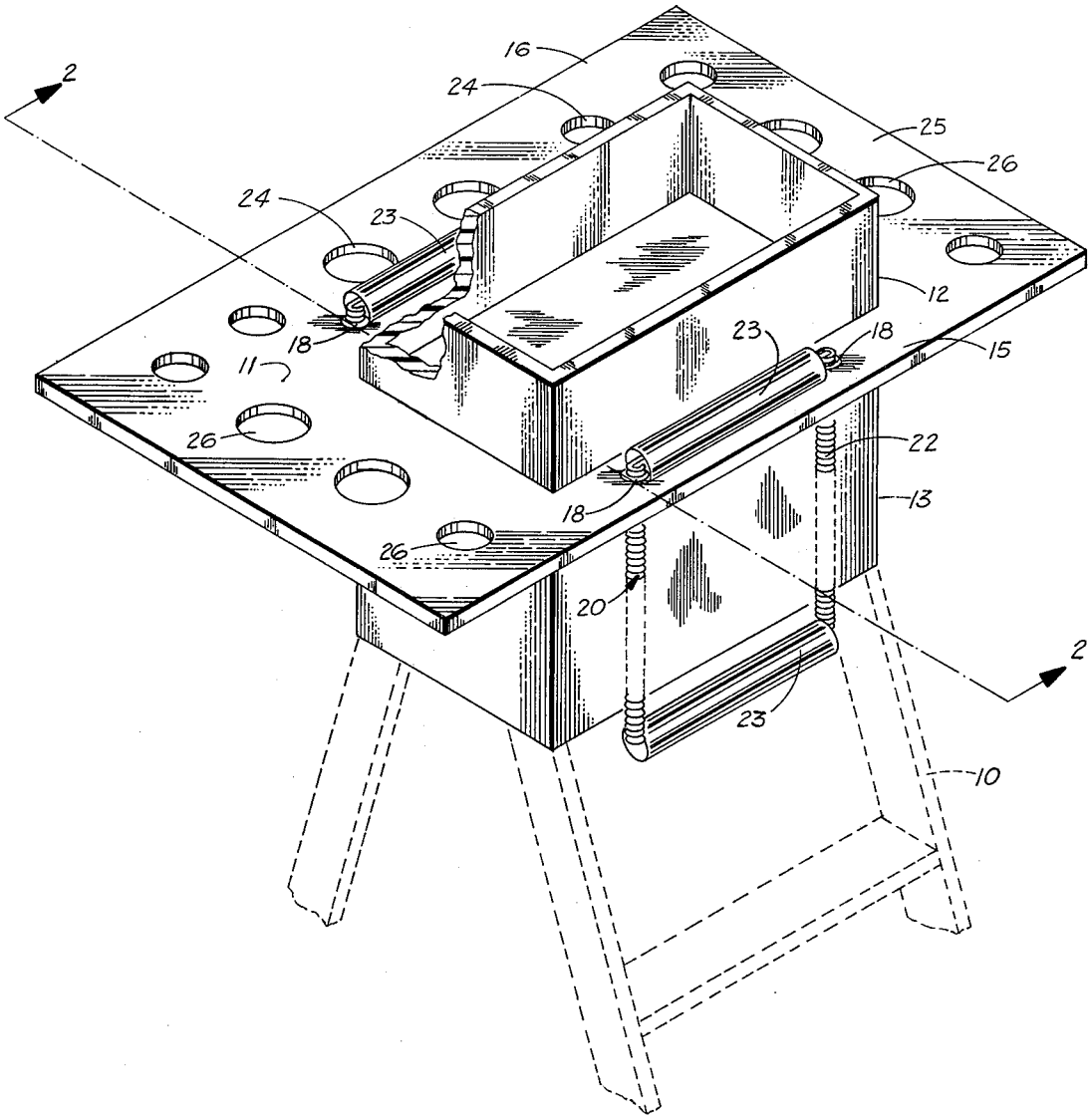
FIG. 1 is a perspective view, partly from above, of an invertible dual carrier embodying the present invention, positioned on top of a folding ladder shown in dashed lines. Elastically bendable handles, shown suspended (and bent inward) in the solid lines shown, are provided to lift and carry the device on being drawn upward and bent inward to the phantom line position.

In the embodiment illustrated in FIG. 1, which is well adapted for molding in a split mold having a parting plane, I provide a substantially planar common wall 11 larger than the top of a folding ladder 10 shown in phantom lines. Extending opposite each other from the common wall 11 are upper rectangular tray walls generally designated 12 and lower rectangular tray walls generally designated 13, which serve as retaining projections over the upper end surface of the ladder 10. At least the inner surfaces of the rectangular wall arrays 12, 13 define rectangles of the same size and having two longer sides and two shorter sides; these are so proportioned as to fit securely over the ladder top step. Hence, when the planar common wall 11 is positioned horizontally and rested atop of the ladder, the inner surfaces of the downward-extending wall arrays 13 will bound the outer edge of the ladder top step, while the upward-projecting walls 12 define a generally rectangular carrier tray. For greater convenience of use, the two trays, in effect so provided, are of different depths, to more securely hold either deeper or shallower articles, as desired. It is, of course, not requisite to the present invention that either the upward projecting walls 12 or the downward projecting walls 13 either have a constant depth; for example, one of the trays so effectually provided might have a single wall of somewhat lesser height, for convenient access, or even a castellated wall. A significant advantage of the present invention, however, is its ability to facilitate handling of articles of different height by inverting or reversing the dual carrier so provided.

To enable the present carrier to serve as such whether or not in place on the top of the ladder 10, it is necessary that means be provided for lifting the carrier from above, regardless which side is up, that is, without inverting it. In the embodiment shown the preferred means are closed rectangular loop handles 20, presented on both sides of the tray portions 12, 13. To provide for the handles, hereafter described, the common planar wall 11 has a near side extension 15 and a far side extension 16, using the terms "near" and "far" in reference to the side of the ladder at which the steps are located. The far sideward extension 16 is substantially broader than the near side extension 15, for a reason hereafter described.

In each of the side extensions 15, 16, adjacent to the outer side of the sides of the rectangular walls 12, 13, are provided a pair of perpendicular bores 18 spaced equidistant from the center of gravity of the carrier. Through each of these passes one of the vertical portions 22 (hereafter to be described) of the rectangular loops, said vertical portions 22 being joined at their ends by rigid horizontal grasping handle portions 23.

The length of the vertical portions 22 is sufficient to permit the upper handle portions 23 to be drawn together when the lower ones are drawn taut against the underside of the wall extensions 15, 16. For maximum convenience, the vertical portions 22 are fabricated of tightly coiled steel wire of such strength and rigidity as to resist extension under ordinary load but to flex or bend elastically sideward. Hence the two grasping handle portions 23 may be drawn upward and inward, bending the vertical portions 22 to the phantom-line positions shown. When the grasping handle portions 23 are then released, they will spring back outward to above the bores 18 (assuming these bores are not too greatly oversize) and then drop by gravity to the non-interfering position shown in solid lines. Alternately, the bores may be in pairs of vertically aligned brackets projecting from the side walls 12, 13 above and below the planar common wall 11.

While the near side extension 15 is so narrow as not to interfere with access by the user when the device is mounted on the top of the ladder 10, the far side extension 16 is made substantially broader and provided with additional bores referred to as tool holding bores 24, of convenient size to hold hand tools such as screw drivers, hammers, pliers, as well as paint burshes and the like.

In the embodiment shown, the planar common wall 11 further has endwise extension portions 25 at both the left and right ends. These extensions are penetrated by similar bores 26, which, along with the bores 24 are similarly referred to as tool holding bores.

Figure 2:
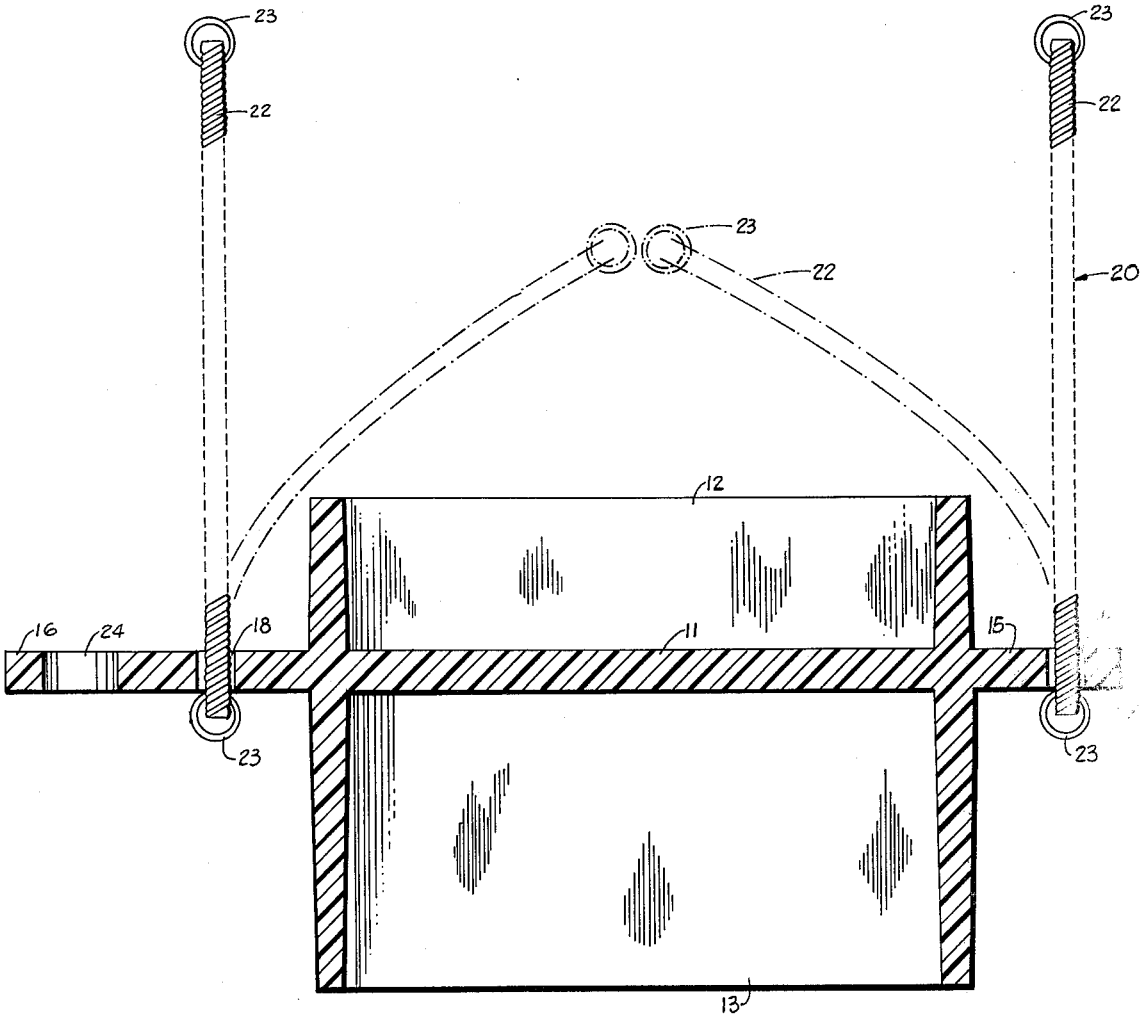
FIG. 2 is a cross-sectional view as seen along line 2—2 of FIG. 1.

Referring to the cross-sectional view FIG. 2, the present device may be readily made by plastic molding in a simple split mold having a parting plane 30 which coincides (at some place along its depth) with the planar common wall 11 and its extension portions 15, 16, 25. With only such taper as is required for easy handling, both the upper and lower rectangular walls 12, 13 may be simply formed, as well as the handle bores 18 and tool holding bores 24, 26. Thus except for the addition of the handles, the present device may be readily made in one piece. For smaller scale production, however, it may be made of metal or even plywood, the manner of construction being apparent to those skilled in the construction of simple devices from those common materials.

A choice is made initially which tray like provision will be used, the shallower provision 12 or the deeper provision 13. The user sets the carrier in position with the tray to be used upward, and loads the tray portion so chosen with paint cans and other articles to be used; simultaneously he may place tools and the like into the tool holding bores 24, 26, in each instance from above. He then draws the handles upward and presses inward to draw them together to the phantom line position shown in the drawings, with the lower handle portions 23 presented against the undersurface of the wall extension portions 15,16. He then carries the device to the top of the ladder and sets it in place, so that the rectangular wall which is inverted (12 or 13) holds the carrier securely on the ladder top. The user then releases the handle grips 23, permitting the elastically bendable vertical loop portions 22 to spring back to vertical position so that the loops may drop through, until the upper handle portions 23 abut against the top surfaces of the wall extension portions 15, 16, as shown in solid lines. In this position they offer no interference with the work to be carried on. When use of the carrier is finished, the user again draws the handles back into the phantom line position, lifts upward and removes the carrier from the ladder top.

The term "substantially planar common wall" refers to its orientation; its surfaces may be grooved or otherwise depart from a plane. Further, it may consist of more than one portion; for example, three, as when two separate trays are riveted together through a central plate.

INDUSTRIAL APPLICABILITY

For manufacture in quantity, the present device is well suited for molding with the wall which forms the tray bottoms and sideward extensions in the parting plane of a simple mold while the tray walls, handle holes, and tool holder bores bring molded fixed cores perpendicular thereto. However, the device can also be readily manufactured of other materials, such as sheet metal.

The uses of the present device are largely for domestic, construction, and property maintenance work, which uses suggest appropriate industrial channels of distribution.

I claim:

1. An invertible dual carrier adapted to be formed by molding in a mold split along a parting plane, comprising a substantially planar common wall in such mold parting plane, a rectangular array of retaining projections extending from each surface of said common wall, the said arrays being opposite each other and so arranged that the inner surfaces of said projections define a rectangle having two longer sides and two shorter sides spaced as to fit securely over such ladder top step, whereby when the said planar common wall is held horizontally and rested atop such a ladder, the downward-extending projections will bound the outer edge of such ladder top step while the upward projections will define a generally rectangular carrier tray, the height of said projections on one side of said common wall being greater than the height of those of the other, whereby on inverting to provide a second carrier tray whose depth differs from that of such first carrier tray, said common planar wall having sideward extension portions along both the longer sides thereof outward of said projections, and bores therethrough extending from both sides to such parting plane, whereby handles may be so attached through some of said bores as to be grasped from either side of said common planar wall, and tools may be carried by insertion through others of said bores.

2. An invertible dual carrier comprising a substantially planar common wall, a rectangular array of retaining projections extending from each surface of said common wall, the said arrays being opposite each other and so arranged that the inner surfaces of said projections define a rectangle having two longer sides and two shorter sides spaced as to fit securely over a ladder top step, whereby when the said planar common wall is held horizontally and rested atop such a ladder, the downward-extending projections will bound the outer edge of such ladder top step while the upward projections will define a generally rectangular carrier tray, said carrier having sideward-projecting means along each of its longer sides to define a pair of spaced-apart bores perpendicular to the plane of said common wall, and closed loop handle means along each of said longer sides and passing through said bores, each said closed loop handle means being of such depth that when drawn upward through and taut against the underside of said bore defining means, to extend sufficiently thereabove for being drawn inward and grasped as a handle.

3. An invertible dual carrier as defined in claim 2, each said loop handle means comprising a pair of elastically bendable vertical portions joined at their upper and lower ends by substantially rigid grasping handle portions, whereby after said loop handle means have been drawn upward together above the carrier are then released, said elastic vertical portions spring the grasping handle portions outward and the vertical portions then drop by gravity through the bores and thus position said loop handle means at a non-interfering level.

* * * * *